US006764285B1

(12) United States Patent
Kellner

(10) Patent No.: US 6,764,285 B1
(45) Date of Patent: Jul. 20, 2004

(54) HYDRAULIC PUMP UNIT

(75) Inventor: Andreas Kellner, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/913,738

(22) PCT Filed: Nov. 23, 1999

(86) PCT No.: PCT/DE99/03713

§ 371 (c)(1),
(2), (4) Date: Mar. 15, 2002

(87) PCT Pub. No.: WO00/50772

PCT Pub. Date: Aug. 31, 2000

(30) Foreign Application Priority Data

Feb. 22, 1999 (DE) ..... 199 07 311

(51) Int. Cl.[7] ..... F04B 19/00

(52) U.S. Cl. ..... 417/470; 417/521; 123/450; 92/72

(58) Field of Search ..... 417/470, 521; 92/72; 123/450

(56) References Cited

U.S. PATENT DOCUMENTS

| | | | | | |
|---|---|---|---|---|---|
| 2,423,701 | A | * | 7/1947 | Hardy | 417/273 |
| 3,604,402 | A | * | 9/1971 | Hatz | 92/72 |
| 3,633,875 | A | * | 1/1972 | Workman, Jr. | 254/266 |
| 3,971,259 | A | * | 7/1976 | Schottler | 417/273 |
| 5,035,221 | A | * | 7/1991 | Martin | 417/273 |
| 5,123,393 | A | * | 6/1992 | Djordjevic | 123/450 |
| 5,634,441 | A | * | 6/1997 | Ragain | 123/54.3 |
| 5,701,873 | A | | 12/1997 | Schneider | |
| 5,816,787 | A | * | 10/1998 | Brinkerhoff et al. | 417/293 |
| 6,216,583 | B1 | * | 4/2001 | Klinger et al. | 417/470 |
| 6,497,216 | B2 | * | 12/2002 | Gaessler et al. | 123/450 |

FOREIGN PATENT DOCUMENTS

| | | |
|---|---|---|
| DE | 15 03 356 A | 1/1970 |
| DE | 31 13 737 A | 10/1982 |
| EP | 0 571 991 A | 12/1992 |

* cited by examiner

*Primary Examiner*—Cheryl J. Tyler
(74) *Attorney, Agent, or Firm*—Ronald E. Greigg

(57) ABSTRACT

The invention relates to a hydraulic pump unit having a plurality of pump elements, disposed in one plane, each of which has one pump cylinder and one pump piston longitudinally displaceable in the pump cylinder, and whose longitudinal axes intersect at a common intersection point, and having a cam drive with cams, which upon a rotation of the cam drive relative to the pump elements act upon the pump pistons with an actuating motion. To enable a uniform pumping of the hydraulic fluid and to make a high degree of smoothness of the hydraulic pump unit possible, it is proposed that the number and the angular spacing of the cams is adapted to the number and angular spacing of the pump elements in such a way that when a certain number of pump pistons are located at top dead center, the same number of pump pistons are at bottom dead center.

20 Claims, 11 Drawing Sheets

HYDRAULIC PUMP UNIT

CROSS-REFERENCE TO RELATED APPLICATIONS

This application is a 35 USC 371 application of PCT/DE 99/03713 filed on Nov. 23, 1999.

BACKGROUND OF THE INVENTION

1. Field of the Invention

The present invention relates to a hydraulic pump unit having a plurality of pump elements, disposed in one plane, each of which has one pump cylinder and one pump piston longitudinally displaceable in the pump cylinder. The longitudinal axes of the pump elements intersect at a common intersection point. The hydraulic pump unit has a cam drive with cams, which upon a rotation of the cam drive relative to the pump elements act upon the pump pistons with an actuating motion. The number and the angular spacing of the cams is adapted to the number and angular spacing of the pump elements in such a way that when a certain number of pump pistons are located at top dead center, the same number of pump pistons are at bottom dead center.

The invention also relates to a high-pressure pump for generating an injection pressure for internal combustion engines.

2. Prior Art

The hydraulic pump units of the type defined at the outset are also known as radial piston pumps. They are used predominantly as high-pressure pumps for generating an injection fuel pressure for an internal combustion engine. However, other possible uses of the hydraulic pump units are also conceivable.

From the prior art, hydraulic pump units of the type defined at the outset are known in various versions. For instance, there are hydraulic pump units in which two pump elements are disposed in an angular spacing of 180° from one another. The pump elements of this known hydraulic pump unit are actuated from inside by a camshaft, which extends perpendicular to the plane of the pump elements and through the intersection point of the longitudinal axes of the pump elements. On the outer circumference of the camshaft, two cams are disposed at an angular spacing of 180°; upon a rotation of the camshaft relative to the pump elements, these cams act upon the pump pistons with an actuating motion. In this internally actuated hydraulic pump unit, the pump pistons are pressed radially inward by spring elements and are pressed outward by the cams of the camshaft, counter to the force of the spring elements. Since the pump elements and the cams are disposed at an angular spacing of 180° from one another, the pump elements are both actuated simultaneously by the cams of the camshaft. The pumping courses of the pump elements are superimposed on one another. Both pump pistons are simultaneously in either a pumping motion or an intake motion. Both pump pistons reach top dead center or bottom dead center at the same instant. The result is a highly uneven pumping characteristic of the known hydraulic pump unit.

In the prior art, externally actuated hydraulic pump units with two or four pump elements, disposed at an angular spacing of 180° and 90°, respectively, from one another, are also known. These units for instance have a cam ring, on whose inside circumference two cams at an angular spacing of 180°, or four cams at an angular spacing of 90°, are embodied. By rotating the cam ring relative to the pump elements, the pump pistons are acted upon by the cams with an actuating motion. In these externally actuated hydraulic pump units, the pump pistons are pressed radially outward by spring elements and are pressed radially inward by the cams of the camshaft counter to the force of the spring elements. In this known embodiment as well, the pump pistons of all the pump elements are in either a pumping motion or an intake motion simultaneously, and all the pump pistons reach either the top dead center or the bottom dead center, as applicable, at the same instant. The result in these known hydraulic pump units as well is a highly uneven pumping characteristic.

Finally, another embodiment of a hydraulic pump unit known from the prior art can be mentioned, in which three pump elements are disposed at an angular spacing of 120° from one another. The pump elements are actuated from inside via a camshaft, on whose outer circumference two cams are disposed at an angular spacing of 180° from one another. The pumping courses of the pump elements of this known hydraulic pump assembly are shown in FIG. 5. The pump pistons of the pump elements C, D, E are located partly in a pumping motion (in the upper region 90) and in an intake motion (in the lower region 91) at the same time, resulting in overlaps 92 in the pumping courses and overlaps 93 in the intake courses of the individual pump elements C, D, E. Because of the overlaps 92, 93, the result in this known hydraulic pump unit is again an uneven pumping characteristic, especially if the pump elements C, D, E are only partly filled.

From the European and German references EP 0 517 991 A1, DE 31 13 737 A1 and DE 1 503 356 A, hydraulic pump units of the type defined at the outset are known. However, these known hydraulic pump units have so many pump elements that a plurality of pump elements are simultaneously in an intake phase or a pumping phase, and thus the pumping courses of the pump elements have overlapping ranges. In intake-regulated hydraulic pump units, this can lead to unequal filling of the pump elements during the intake phase and a resultant unequal pumping during the pumping phase, since the pump units, for technical production reasons, are not embodied absolutely identically. This has an adverse effect on the power and noise production in the hydraulic pump unit. As prior art, reference is also made to U.S. Pat. Nos. 2,423,701 and 5,701,873.

It is the object of the present invention for a hydraulic pump unit of the type defined at the outset to be designed and refined in such a way that particularly in the event of partial filling, it makes uniform pumping of the hydraulic fluid possible.

To attain this object, based on the hydraulic pump unit of the type defined at the outset, the invention proposes that the cam drive has precisely two cams, disposed at an angular spacing of 180° from one another, and the hydraulic pump unit has precisely two pump elements disposed at an angular spacing of 90° from one another.

In a further way of attaining the object of the present invention it is proposed that the cam drive has precisely three cams, disposed at an angular spacing of 120° from one another, and the hydraulic pump unit has precisely two pump elements disposed at an angular spacing of 60° from one another.

According to the invention, it has been recognized that the hydraulic pump unit has an especially uniform pumping characteristic whenever the hydraulic pump unit has an even number of pump elements, so that in each case an equal number of pump elements can be actuated contrary to one another, and at any instant the same equal number of pump pistons are located in opposed pumping and intake positions.

In the hydraulic pump unit of the invention, a certain number of pump pistons are acted upon, upon a rotation of the cam drive relative to the pump elements, with a pumping motion or an intake motion. At the same time the same number of pump pistons is acted upon by an opposite actuating motion in the form of an intake motion and a pumping motion, respectively. For instance if the instant of the actuating motion at which a certain number of the pump pistons is at top dead center is discovered, then at the same instant the same number of pump pistons is at bottom dead center.

The hydraulic pump unit of the invention, especially in the event of partial filling of the pump elements with fuel, has an especially uniform pumping characteristic, since in the pumping courses of the individual pump elements of the hydraulic pump unit, overlaps or, which would be worse, superpositions do not occur.

In a preferred refinement of the present invention, it is proposed that the cams of the cam drive act upon the pump pistons from inside with an actuating motion. Advantageously, the cam drive is embodied as a camshaft, which extends through the intersection point, perpendicular to the plane in which the pump elements are located, and on whose outer circumferential surface the cams are embodied.

In another advantageous refinement of the present invention, the pump pistons pump the hydraulic fluid to the radially outer end of the pump elements. From the radially outer ends of the pump elements, the pumped hydraulic fluid can then be carried out of the hydraulic pump unit and delivered to a common rail via supply lines located outside the hydraulic pump unit. As a result, the high pressure is shifted out of the housing of the hydraulic pump unit into the externally located supply lines. The housing can be designed for merely low pressure and can be produced correspondingly less expensively.

Finally, it is proposed that the hydraulic pump unit be used as a high-pressure pump for generating an injection pressure for a fuel-operated internal combustion engine. Especially in a use as a high-pressure pump, the advantages of the hydraulic pump unit of the invention, that is, a uniform pumping characteristic and a high degree of operating smoothness, become especially important.

As another way of attaining the object of the present invention, it is proposed on the basis of the high-pressure pump of the type defined at the outset that a plurality of the hydraulic pump units of the invention are disposed one after the other in such a way that the pump elements of all the hydraulic pump units are acted upon with an actuating motion by the same cam drive.

In an advantageous refinement of the present invention, it is proposed that two hydraulic pump units are disposed one after the other in such a way that the planes in which the pump units are located extend parallel to one another, and that the intersection points of the pump units of the hydraulic pump units are located on the same camshaft.

Advantageously, the hydraulic pump units are disposed congruently one after the other. Alternatively, it is proposed that the hydraulic pump units are disposed one after the other, rotated by an angular offset of 180°.

BRIEF DESCRIPTION OF THE DRAWINGS

A preferred exemplary embodiment of the present invention will be described below in further detail in conjunction with the drawings. Shown are.

DESCRIPTION OF THE PREFERRED EMBODIMENTS

Figure 1:
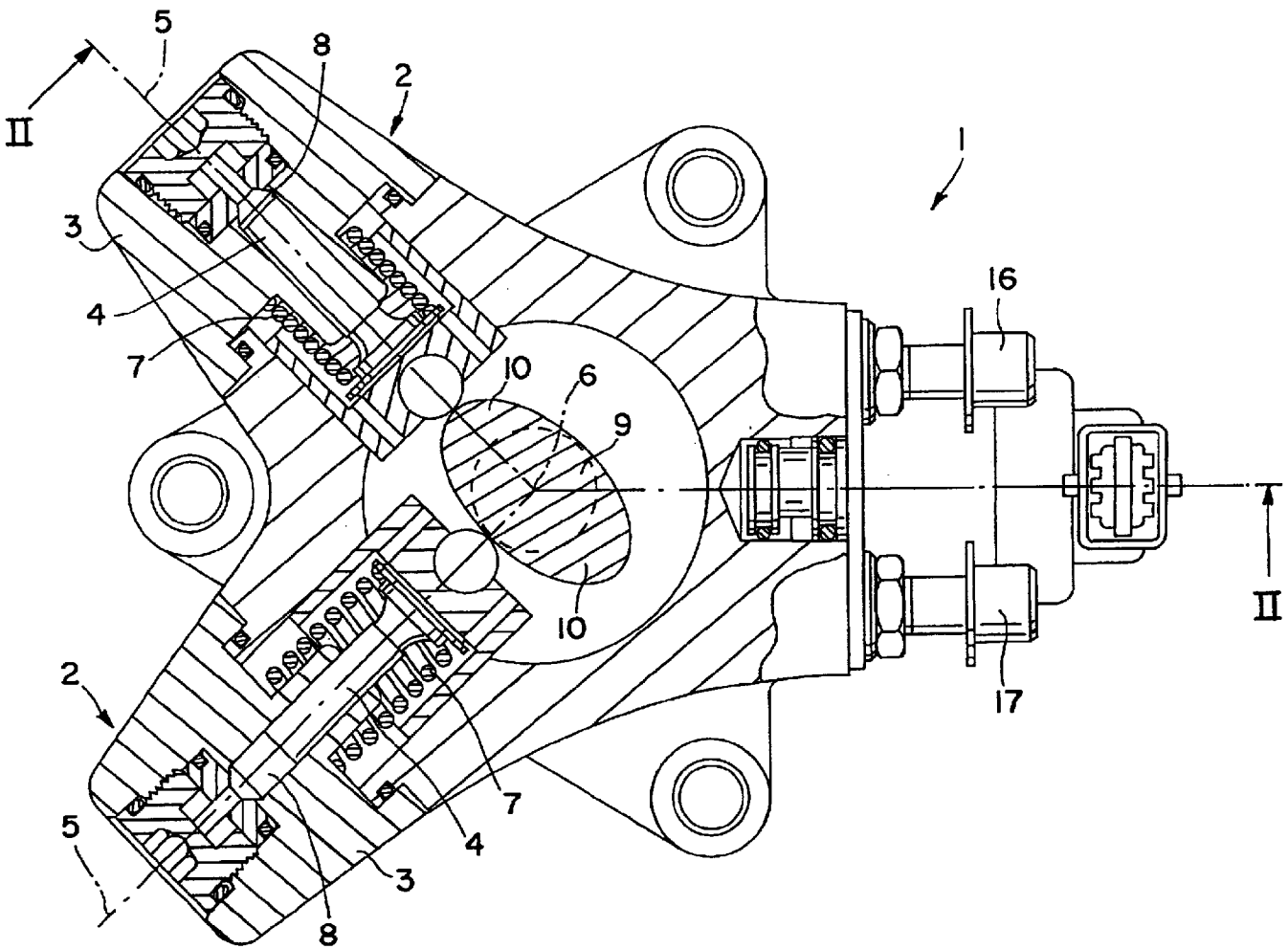
FIG. 1, a hydraulic pump unit of the invention in a preferred embodiment, in a sectional plan view.
Figure 2:
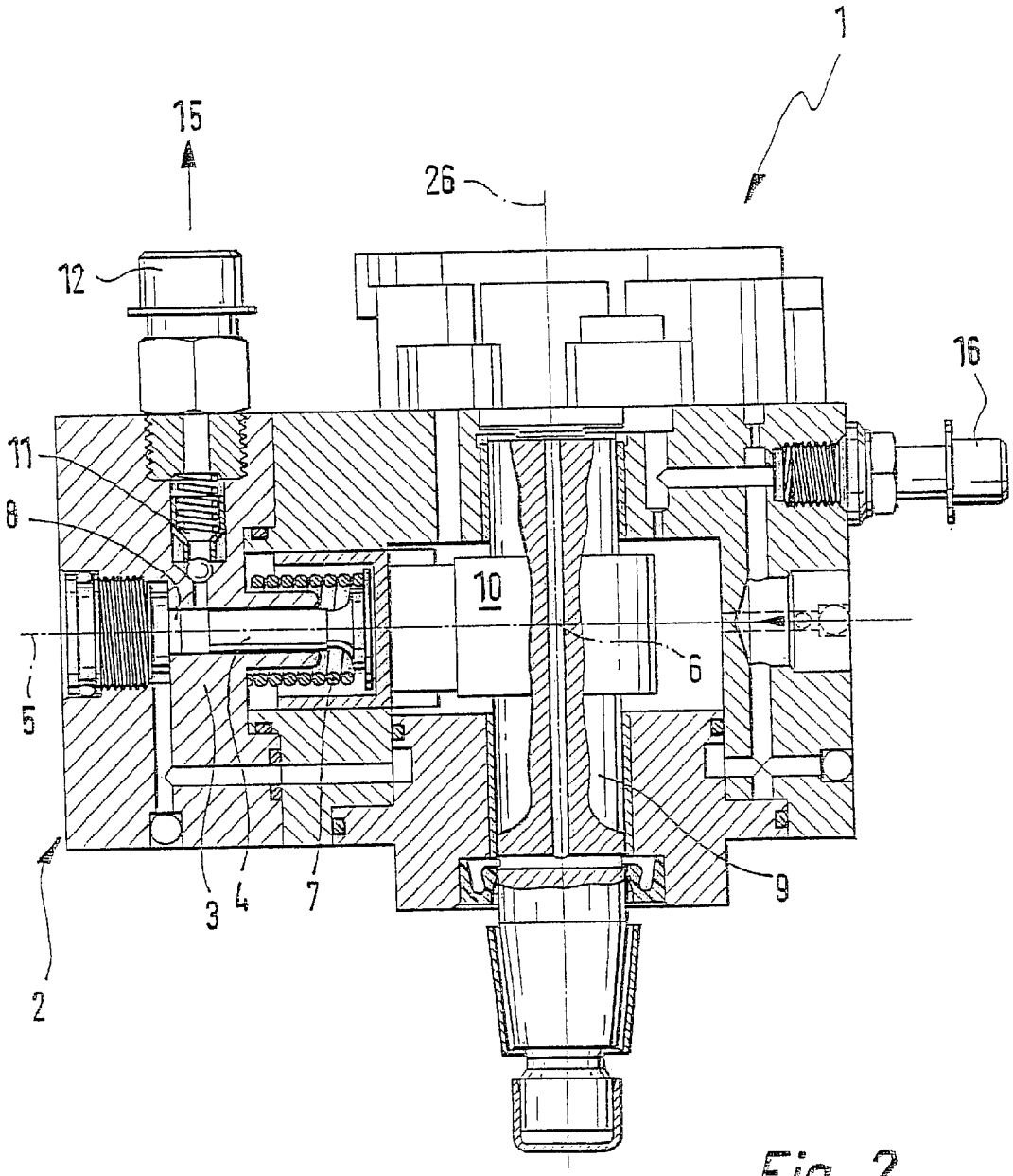
FIG. 2, the hydraulic pump unit of FIG. 1 in a cross section taken along the line II—II.

In FIG. 1 and FIG. 2, a hydraulic pump unit of the invention is identified overall by reference numeral 1. The hydraulic pump unit 1 is embodied as a radial piston pump. By way of example, it is used as a high-pressure pump 18 (see FIG. 3) for generating an injection pressure for liquid fuel-operated internal combustion engines. The hydraulic pump unit 1 has two pump elements 2, which are disposed in the same plane. Each pump element 2 has one pump cylinder 3 and one pump piston 4 longitudinally displaceable therein. The longitudinal axes 5 of the pump elements 2 intersect at an intersection point 6.

The pump piston 4 pumps a hydraulic fluid, such as fuel, to the radially outer end of the pump element 2. The pump piston 4 is pressed radially inward by a spring element 7 in the direction of the intersection point 6. In this position, a pump chamber 8 of the pump element 2 has its largest volume. The pump chamber 8 is filled with fuel from a metering unit 14. The pump chamber 8 leads out of the hydraulic pump unit 1 via a pressure valve 11 and a connection stub 12.

The hydraulic pump unit 1 is internally actuated. It has a camshaft 9, which extends perpendicular to the plane of the pump elements 2 and through the intersection point 6 of the longitudinal axes 5 of the pump elements 2. More precisely, the longitudinal axis 26 of the camshaft 9 extends through the intersection point 6. On the outer circumferential surface of the camshaft 9, two cams 10 are formed, which act upon the pump pistons 4 successively with a radially outer-oriented pumping motion when the camshaft 9 rotates relative to the pump elements 2.

Within the scope of the pumping motion, the pump piston 4 of a pump element 2 is pressed radially outward, counter to the force of the spring element 7, from bottom dead center (BDC) to top dead center (TDC). This reduces the volume of the pump chamber 8, and the fuel located in it is compressed and pumped at high pressure out of the hydraulic pump unit 1, via the pressure valve 11 and the connection stub 12. Connected to the connection stub 12 is a supply line 13, by way of which the pumped fuel is carried to a high-pressure reservoir 15 or a common rail, for instance in a common rail system.

While one pump piston 4 is executing a pumping motion, the other pump piston 4 executes an intake motion from top dead center (TDC) to bottom dead center (BDC). Within the scope of the intake motion, the pump piston 4 aspirates fuel, delivered from the metering unit 14, into the pump chamber 8, and this fuel is then pumped into the common rail 15 in the ensuing pumping motion.

The pump elements 2 of the hydraulic pump unit 1 have an angular spacing of 90° from one another. An inlet 16 from the metering unit 14 and a return 17 are disposed at an angular spacing of about 135° from the pump elements 2. The cams 10 are disposed on the outer circumference of the camshaft 9 at an angular spacing of 180° from one another. The number and angular spacing of the cams 10 is adapted to the number and angular spacing of the pump elements 2 in such a way that when one pump piston 4 is located at top dead center (TbC), the other pump piston 4 is located at bottom dead center (BDC) (as seen in FIGS. 4, 6, 11, and 12). As a result, a uniform pumping characteristic and a high degree of operating smoothness of the hydraulic pump unit 1 of the invention is attained, even at high rotary speeds of the camshaft 9.

Figure 3:
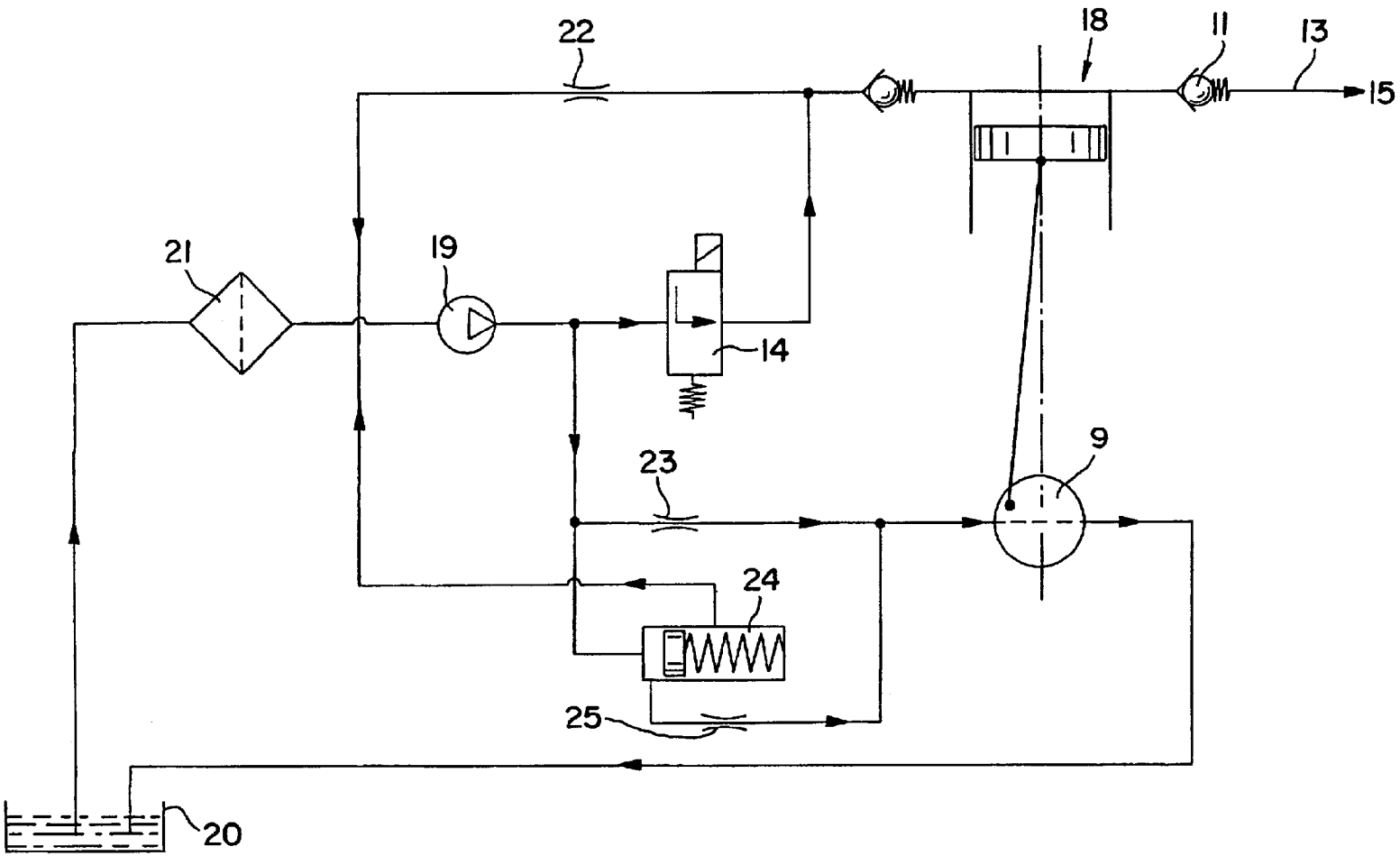
FIG. 3, a circuit diagram for generating high pressure

In FIG. 3, a circuit diagram for generating high pressure for a common rail system with a high-pressure pump 18 of the invention is shown. The high-pressure pump 18 is embodied as a hydraulic pump unit 1 of FIGS. 1 and 2 and is shown only symbolically in FIG. 3.

A feed pump 19 aspirates fuel from a fuel tank 20 via a filter 21 and pumps it to upstream of the metering unit 14 and a cascade overflow valve 24. The metering unit 14 is embodied as a proportional valve and carries the fuel onward to the high-pressure pump 18. When the metering unit 14 is closed, the leakage through the metering unit 14 is aspirated from the feed pump 19 via a zero feed throttle restriction 22. Between the feed pump 19 and the metering unit 14, a line branches off that carries some of the fuel, pumped by the feed pump 19, to a parallel circuit comprising a venting throttle restriction 23 on the one hand and a series circuit of the cascade overflow 24 and a lubricating throttle restriction 25 on the other. By means of the cascade overflow valve 24, the fuel pressure can be regulated to a constant value. The excess fuel is delivered to the inlet to the feed pump 19. The fuel from the venting throttle restriction 23 and the lubricating throttle restriction 25 is supplied for lubrication and cooling purposes to the bearing of the camshaft 9 and is then carried back into the fuel tank 20.

Figure 4:
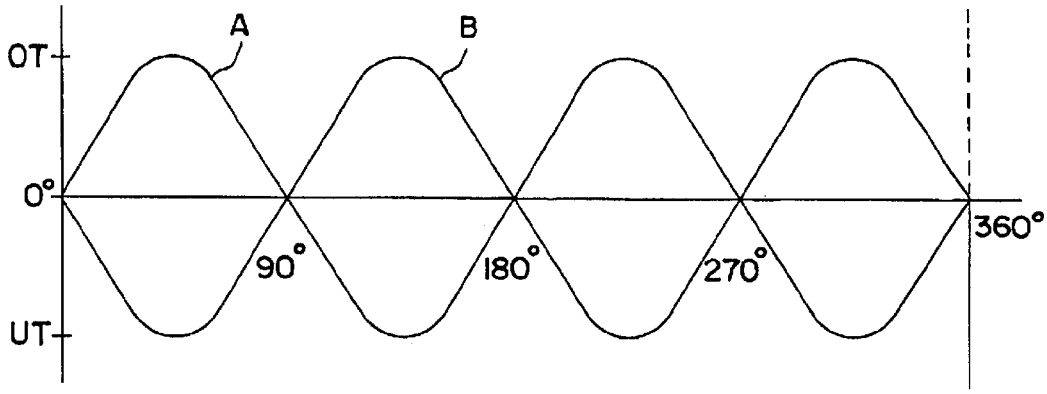
FIG. 4, pumping courses of the pump elements of the hydraulic pump unit of FIG. 1 and FIG. 2.
Figure 5:
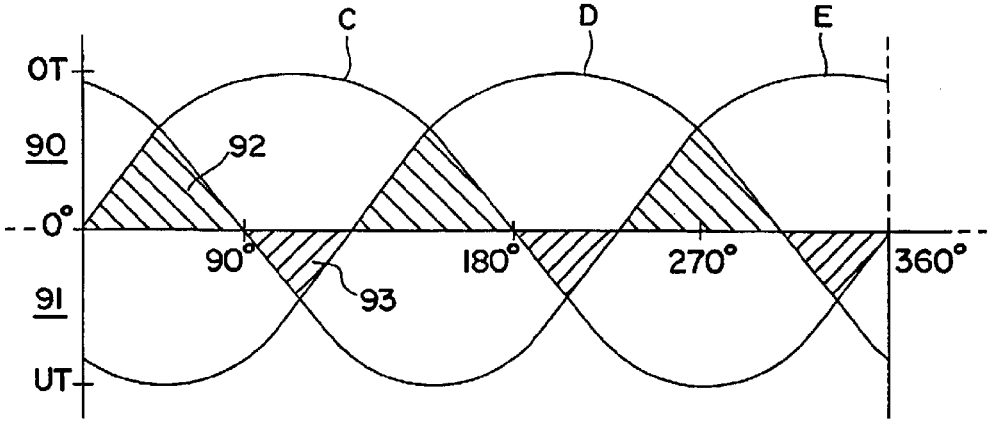
FIG. 5 PRIOR ART
FIG. 5, pumping courses of the pump elements of a hydraulic pump unit known from the prior art.

In FIG. 4, the pumping courses of the two pump elements 2 of the hydraulic pump unit 1 of the invention, in accordance with the exemplary embodiment of FIG. 1 and FIG. 2, are shown. The pumping courses of the individual pump elements are identified by the letters A and B, for the sake of clarity. It can be seen clearly that at the instant when the pumping course A is located at top dead center (TDC), the pumping course B is at bottom dead center (BDC). When one pump element 2 is in a pumping motion, the other pump element 2 is in an intake motion. By the rotation of the camshaft 9, the two pump elements 2 are accordingly acted upon by an opposed actuating motion.

Figure 6:
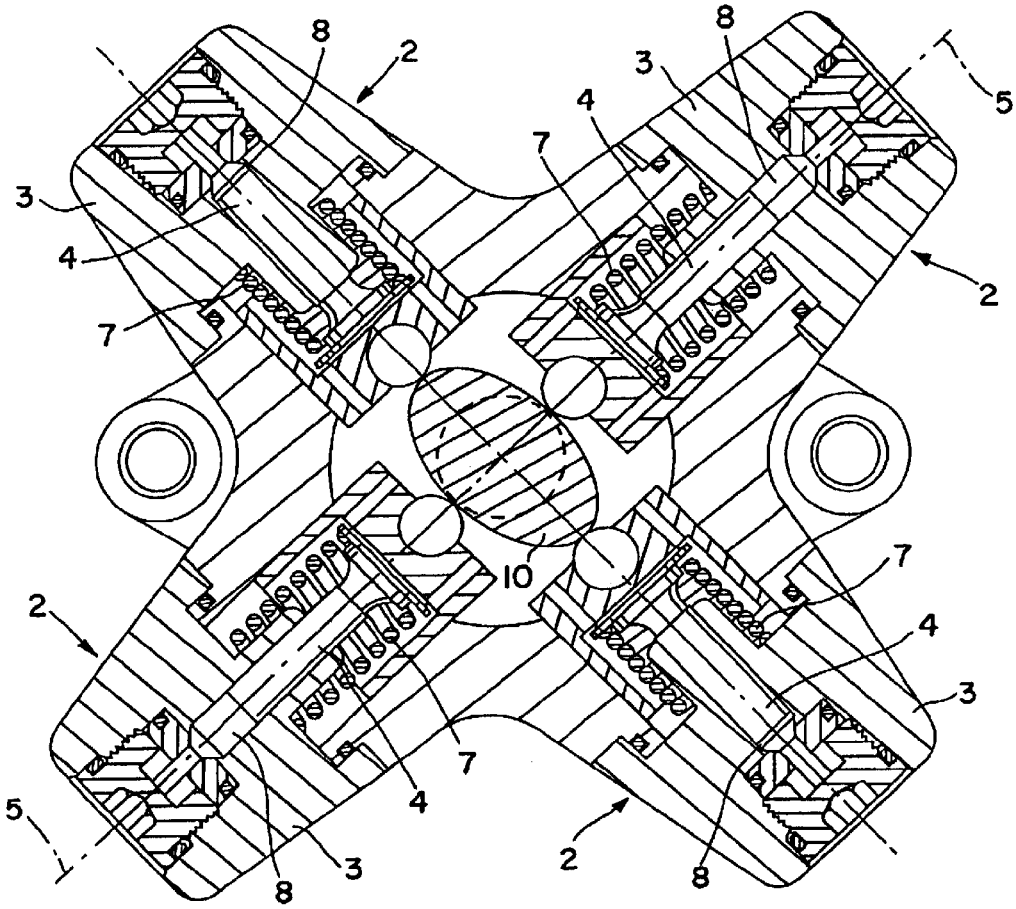
FIG. 6, a hydraulic pump unit of the invention in an embodiment with four pump elements, in a sectional plan view.

In FIG. 6, there are shown four pump elements (2), having an angular spacing of 90° about the axis of the cam shaft (9) so that with two cams (10), spaced angularly by 180° about the axis of the cam shaft (9), so that two opposing pistons (4) will simultaneously be at top dead center (TDC), and while there, the two other pistons will be at bottom dead center (BbC).

Figure 7:
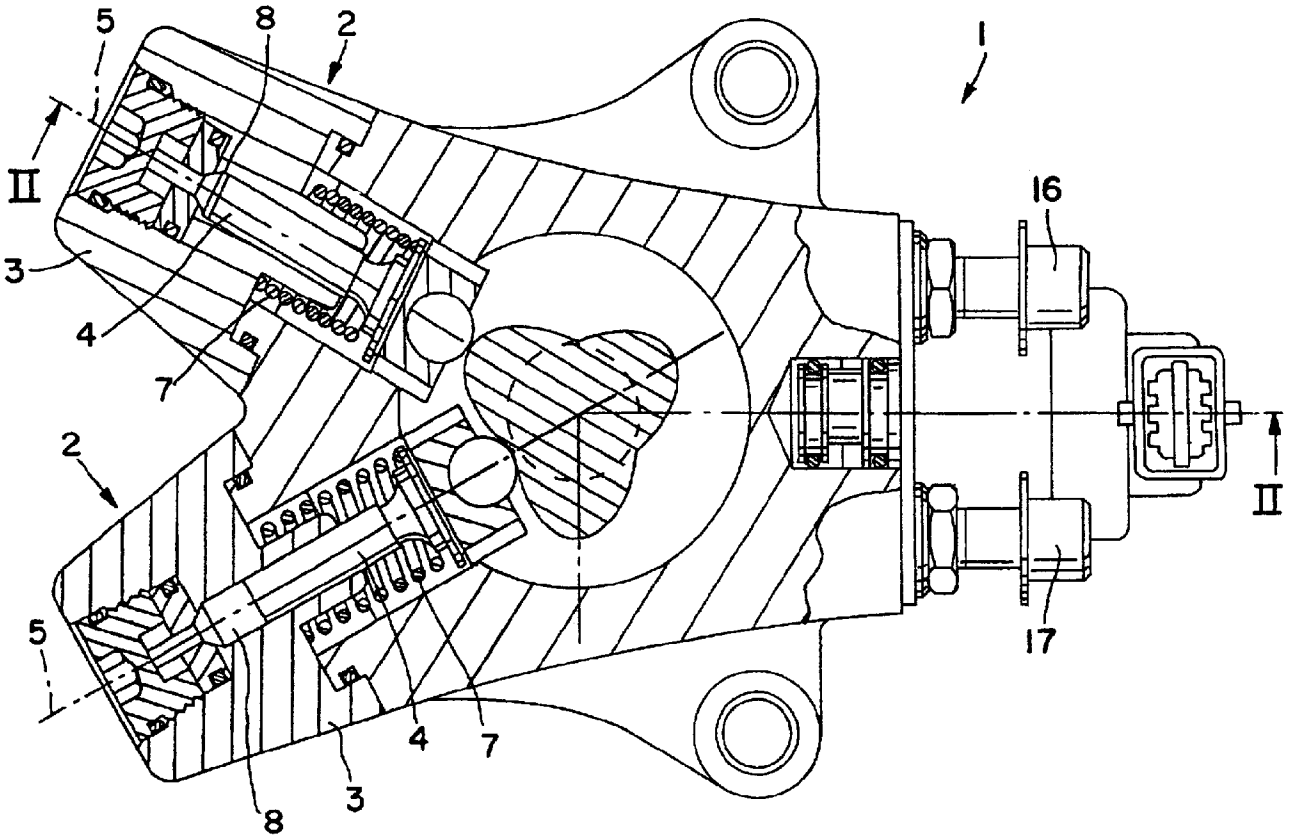
FIG. 7, a hydraulic pump unit of the invention in an embodiment in which the pump elements are spaced about the axis at 60°, in a sectional plan view.

In FIG. 7, there are shown two pump elements (2), having an angular spacing of 60° about the axis of the cam shaft (9) so that with three cams (10), spaced angularly by 120° about the axis of the cam shaft (9), so that when one of the two pistons (4) is at top dead center (TDC), the other will be at bottom dead center (BDC).

Figure 8:
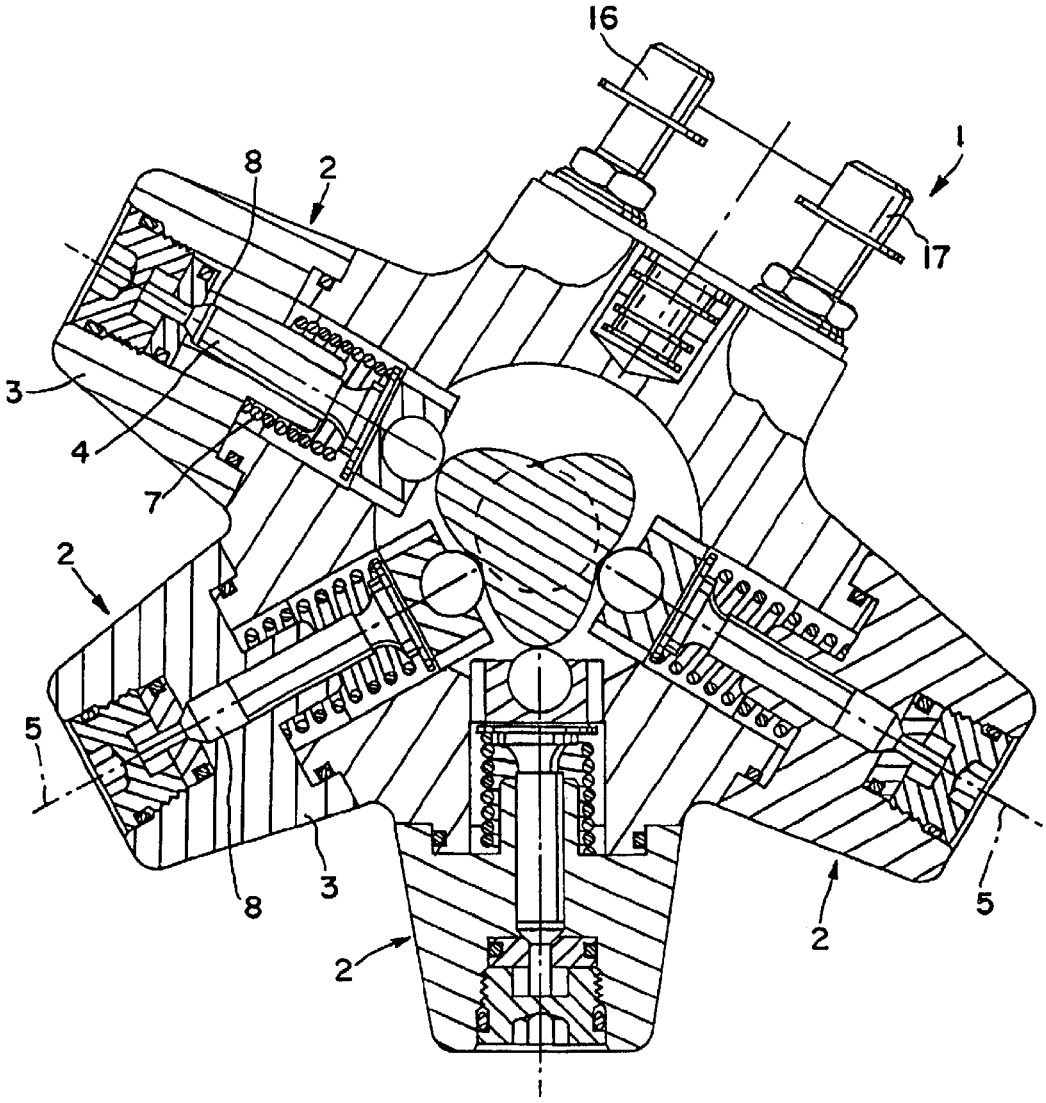
FIG. 8, a hydraulic pump unit of the invention in an embodiment in which there are four pump elements, each spaced about the axis at 60°, in a sectional plan view.

In FIG. 8, there are shown four pump elements (2), having an angular spacing of 60° about the axis of the cam shaft (9), so that with three cams (10) spaced angularly by 120° about: the axis of the cam shaft (9), so that for every piston (4) which is at top dead center (TDC), there will be another piston (4) at bottom dead center (BDC).

Figure 9:
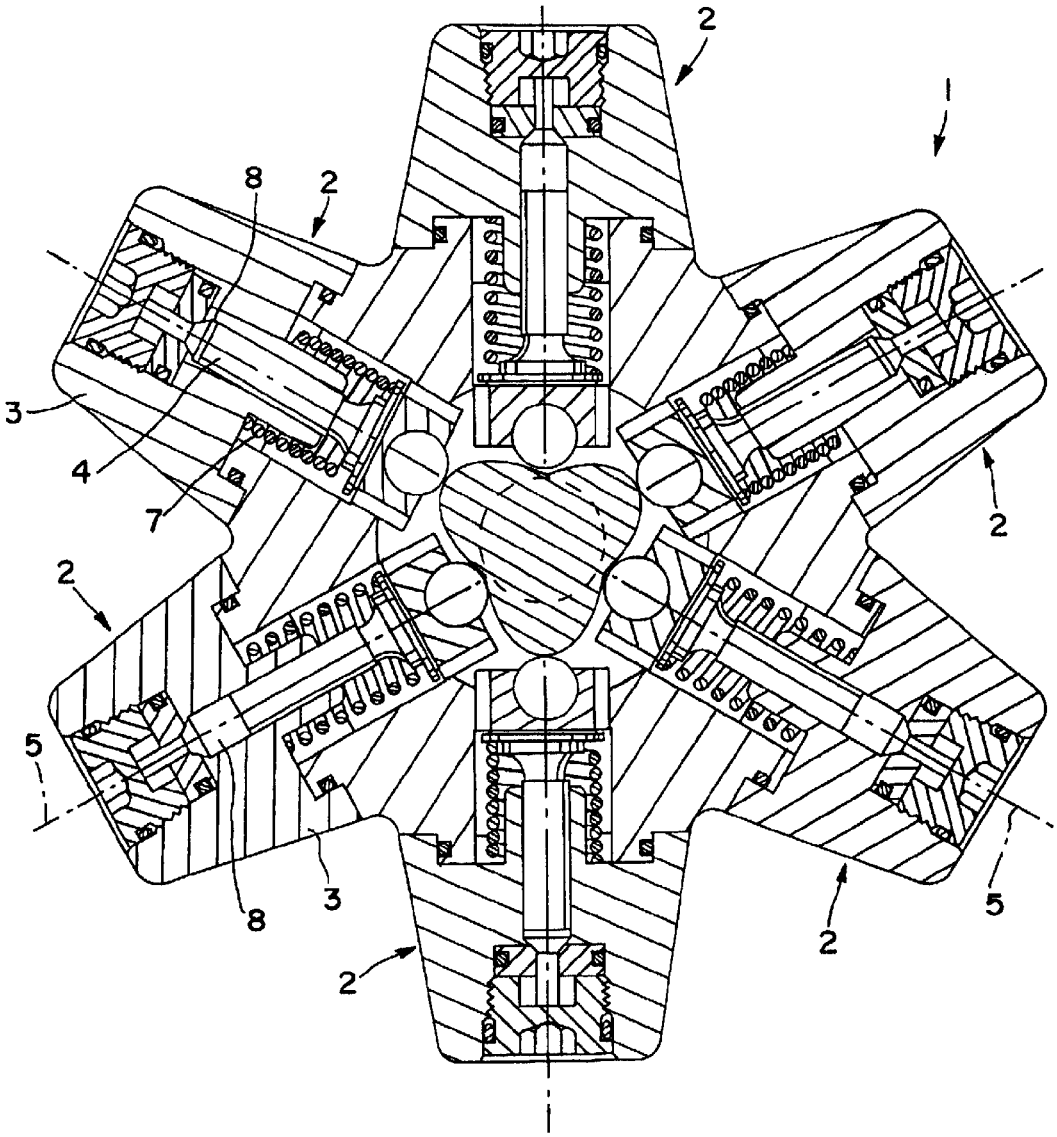
FIG. 9, a hydraulic pump unit of the invention in an embodiment in which there are six pump elements, each spaced about the axis at 60°, in a sectional plan view.

In FIG. 9, there are shown six pump elements (2), having an angular spacing of 60° about the axis of the cam shaft (9), so that with three cams (10), spaced angularly by 120° about the axis of the cam shaft (9), so that for each piston (4) which is at top dead center (TDC), there will be another piston (4) at bottom dead center (BDC).

Figure 10:
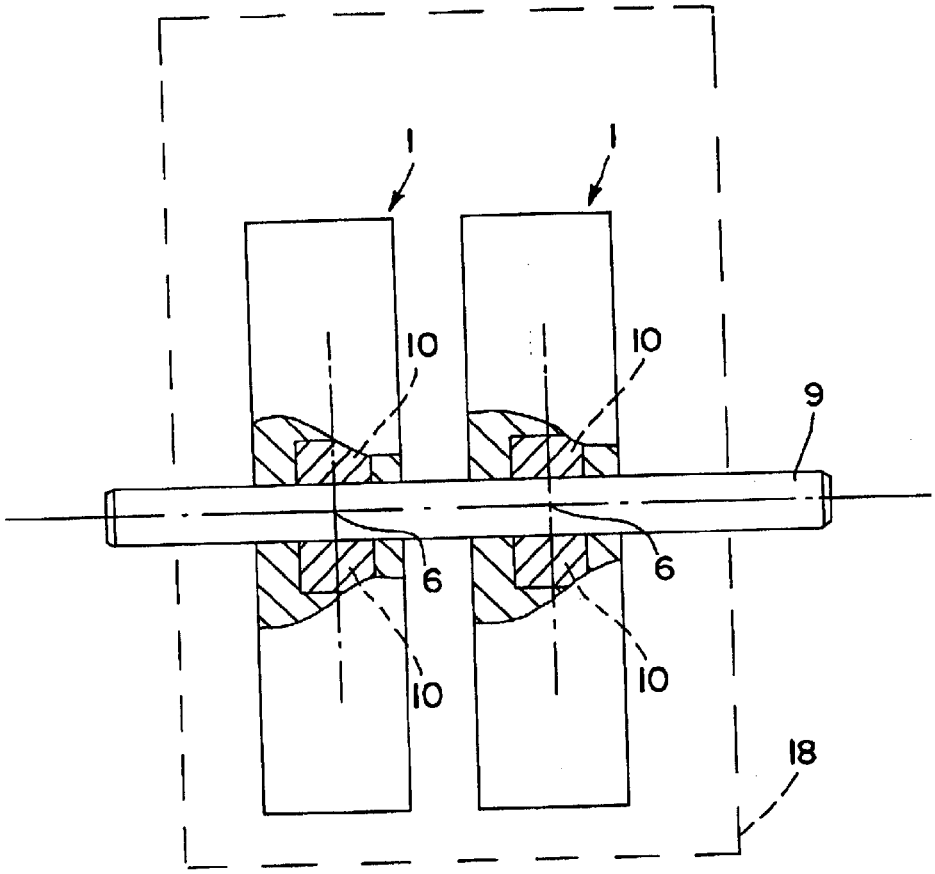
FIG. 10, a hydraulic pump unit of the invention in an embodiment in which there are two pump units spaced along the axis.

In FIG. 10, there are shown two pump units (1), each having a plurality of pump elements (2). The two pump units (1) are spaced along the axis of the cam shaft (9). Again, the angular spacing of the pistons and the cams are such that when one of the pistons (4) is at top dead center (TDC), there will be another piston (4) at bottom dead center (BDC).

Figure 11:
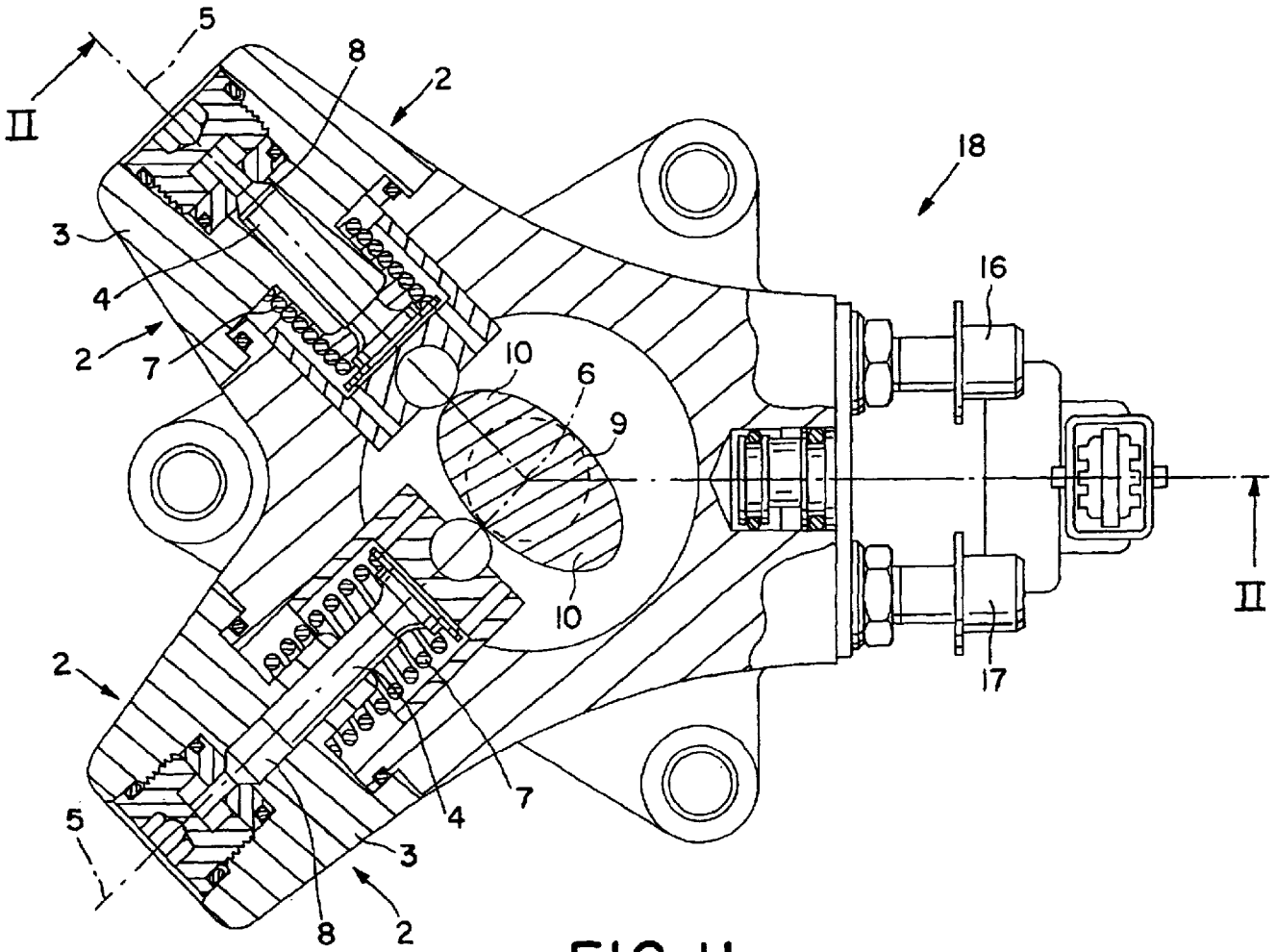
FIG. 11, a hydraulic pump unit of the invention in an embodiment in which there are four pump elements, two being shown in cross section, and two spaced behind the plane of FIG. 11.
Figure 12:
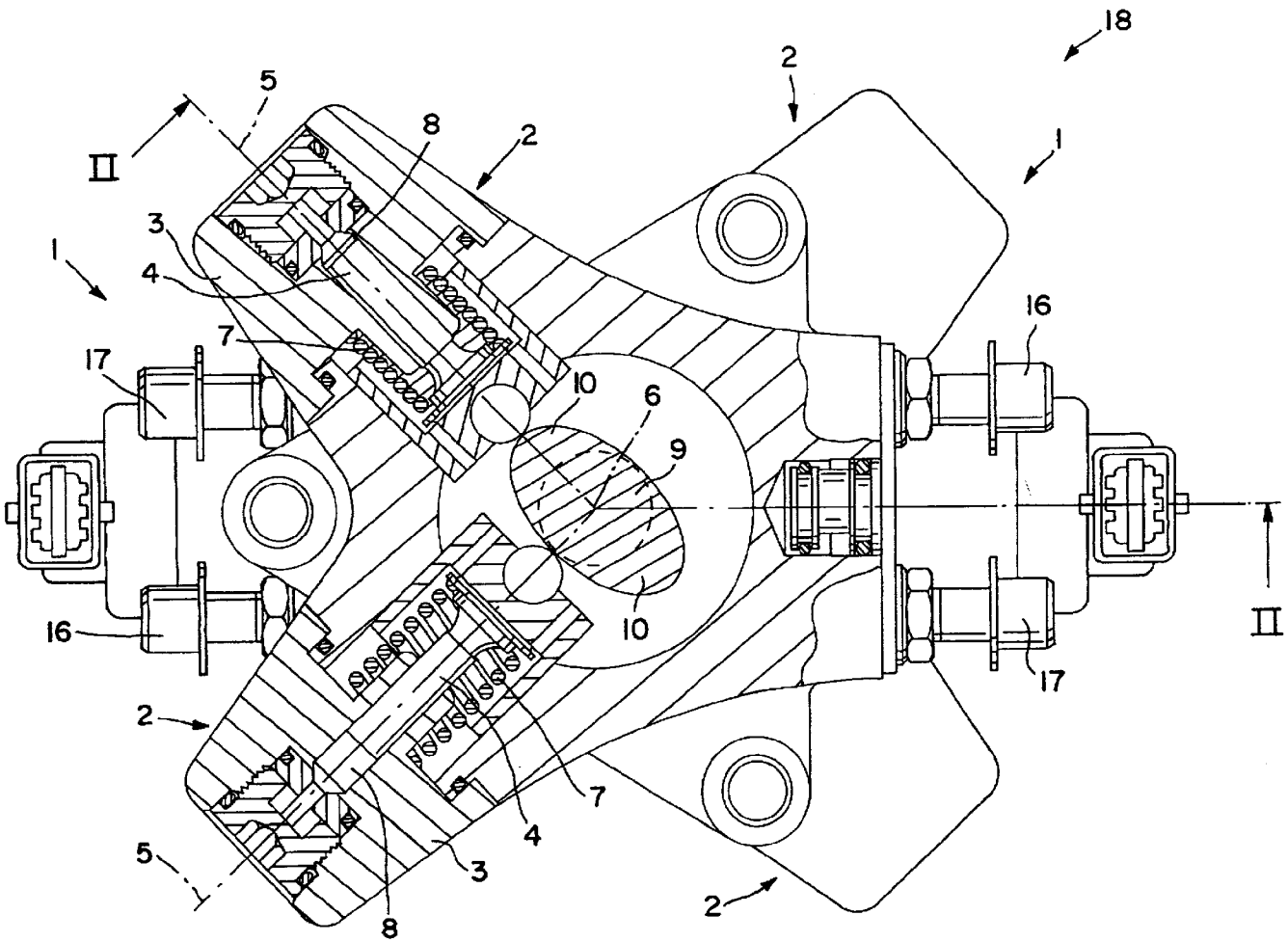
FIG. 12, a hydraulic pump unit of the invention in an embodiment similar to that shown in FIG. 11, in which two pump elements are shown in cross section, and another two can be seen behind the plane of FIG. 12.

FIG. 12 is a representation similar to FIG. 10, where there are two planes of pump units (1) spaced along the axis of the camshaft (9). In the instance of FIG. 12, the first of the pump units (1) is shown in cross section, and the second of the pump units (1) is spaced behind the plane of the first pump unit (1). As can be seen in FIG. 12, the pump elements (2) of the second unit (1) are rotated about the axis of the camshaft (9) by 180° with respect to the pump elements (2) of the first unit (1) so that they can be seen, represented schematically behind the pump elements (2) of the first pump unit (1). In this embodiment also, when one or more of the pistons (4) are at top dead center (TDC), there will be a corresponding one or more pistons (4) at bottom dead center (BDC). FIG. 11 is similar to FIG. 12, however in this instance the second pump unit (1) is not rotated with respect to the first pump unit (1), so that the pump elements (2) of the second unit (1) cannot be seen, as they are behind the pup elements (2) of the first unit.

The foregoing relates to preferred exemplary embodiments of the invention, it being understood that other variants and embodiments thereof are possible within the spirit and scope of the invention, the latter being defined by the appended claims.

I claim:

1. A hydraulic pump unit (1) for supplying fuel to an internal combustion engine, comprising:

a plurality of pump elements (2), disposed in one plane, each of which has one pump cylinder (3) and one pump piston (4) longitudinally displaceably in the pump cylinder (3), and whose longitudinal axes (5) intersect at a common intersection point (6);

a cam drive with cams (10), which upon a rotation of the cam drive relative to the pump elements (2) act upon the pump pistons (4) with an actuation motion, the number and the angular spacing of the cams (10) being adapted to the number and angular spacing of the pump elements (2) in such a way that when a certain number of pump pistons (4) are located at top dead center (TDC), the same number of pump pistons (4) are at bottom dead center (BDC);

the pump elements (2) of the pump unit (1) receiving the fuel from a metering unit (14); and the pumping courses of the individual pump elements (2) having no overlaps.

2. The hydraulic pump unit (1) of claim 1, characterized in that the cams (10) of the cam drive act upon the pump pistons (4) from inside with an actuating motion.

3. The hydraulic pump unit (1) of claim 2, characterized in that the cam drive is embodied as a camshaft (9), which extends through the intersection point (6), perpendicular to the plane in which the pump elements (2) are located, and on whose outer circumferential surface the cams (10) are biased against.

4. The hydraulic pump unit (1) of claim 1, characterized in that the cam drive has two cams (10), disposed at an angular spacing of 180° from one another.

5. The hydraulic pump unit (1) of claim 4, characterized in that the hydraulic pump unit (1) has two pump elements (2), which have an angular spacing of 90° from one another.

6. The hydraulic pump unit (1) of claim 4, characterized in that the hydraulic pump unit (1) has four pump elements (2), which have an angular spacing of 90° from one another.

7. The hydraulic pump unit (1) of claim 1, characterized in that the cam drive has three cams (10), disposed at an angular spacing of 120° from one another.

8. The hydraulic pump unit (1) of claim 7, characterized in that the hydraulic pump unit (1) has two pump elements (2), which have an angular spacing of 60° from one another.

9. The hydraulic pump unit (1) of claim 7, characterized in that the hydraulic pump unit (1) has four pump elements (2), which have an angular spacing of 60° from one another.

10. The hydraulic pump unit (1) of claim 1, characterized in that the pump pistons (4) pump fuel to the radially outer end of the pump elements (2).

11. The hydraulic pump unit (1) of claim 1, characterized in that the hydraulic pump unit (1) is embodied as a high-pressure pump (18) for generating an injection pressure for a fuel-operated internal combustion engine.

12. A high pressure pump (18) for generating an injection pressure for fuel-operated internal combustion engines, comprising a plurality of hydraulic pump units (1), each said pump unit (1) including:

a plurality of pump elements (2), disposed in one plane, each of which has one pump cylinder (3) and one pump piston (4) longitudinally displaceable in the pump cylinder (3), and whose longitudinal axes (5) intersect at a common intersection point (6);

a cam drive with cams (10), which upon a rotation of the cam drive relative to the pump elements (2) act upon the pump pistons (4) which an actuation motion, the number and the angular spacing of the cams (10) being adapted to the number and angular spacing of the pump elements (2) in such a way that when a certain number of pump pistons (4) are located at top dead center (TDC), the same number of pump pistons (4) are at bottom dead center (BDC);

the pump elements (2) of the pump unit (1) receiving the fuel from a metering unit (14);

the pumping courses of the individual pump elements (2) having no overlaps; and said pump units (1) being disposed one behind the other in such a way that the planes in which the pump units (1) are located extend parallel to one another, and that the intersection points (6) of the hydraulic pump units (1) are located on the same camshaft (9) and that the pump elements (2) of all the hydraulic pump units (1) are acted upon with an actuating motion by the same cam drive.

13. The hydraulic pump unit (1) of claim 12, characterized in that the hydraulic pump unit (1) has six pump elements (2), which have an angular spacing of 60° from one another.

14. The high-pressure pump (18) of claim 12, characterized in that the number and angular spacing of the pump elements (2) of the hydraulic pump units (1) and the angular offset of the hydraulic pump units (1) from one another are adapted to the number and angular spacing of the cams (10) in such a way that when a certain number of pump pistons (4) of the high-pressure pump (18) are located at top dead center (TDC), the same number of pump pistons (4) are located at bottom dead center (BDC).

15. The high-pressure pump (18) of claim 14, characterized in that two hydraulic pump units (1) are disposed one after the other in such a way that the planes in which the pump units (2) are located extend parallel to one another, and that the intersection points (6) of the pump units (2) of the hydraulic pump units (1) are located on the same camshaft (9).

16. The high-pressure pump (18) of claim 15, characterized in that the hydraulic pump units (1) are disposed congruently one after the other.

17. The high-pressure pump (18) of claim 15, characterized in that the hydraulic pump units (1) are disposed one after the other, and are rotated by an angular offset of 180° with respect to each other.

18. The hydraulic pump unit (1) of claim 12, characterized in that the cams (10) of the cam drive act upon the pump pistons (4) from inside with an actuating motion.

19. The hydraulic pump unit (1) of claim 18, characterized in that the cam drive is embodied as a camshaft (9), which extends through the intersection point (6), perpendicular to the plane in which the pump elements (2) are located, and on whose outer circumferential surface the cams (10) are embodied.

20. The high-pressure pump (18) of claim 12, characterized in that the number and angular spacing of the pump elements (2) of the hydraulic pump units (1) and the angular offset of the hydraulic pump units (1) from one another are adapted to the number and angular spacing of the cams (10) in such a way that when a certain number of pump pistons (4) of the high-pressure pump (18) are located at top dead center (TDC), the same number of pump pistons (4) are located at bottom dead center (BDC).

* * * * *